US007361068B2

(12) United States Patent
Hwang et al.

(10) Patent No.: US 7,361,068 B2
(45) Date of Patent: Apr. 22, 2008

(54) SEAL PRESSURE VENT SYSTEM FOR A WATERJET APPARATUS

(75) Inventors: Mingfong Hwang, Phoenix, AZ (US); Arun Kumar, Chandler, AZ (US); Albert G. Selder, Gilbert, AZ (US); William A. Facinelli, Phoenix, AZ (US); Louie T. Gaines, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 83 days.

(21) Appl. No.: 11/444,088

(22) Filed: May 31, 2006

(65) Prior Publication Data

US 2007/0281560 A1 Dec. 6, 2007

(51) Int. Cl.
*B63H 11/00* (2006.01)
*B63H 11/103* (2006.01)

(52) U.S. Cl. ..... 440/38; 440/39; 440/47

(58) Field of Classification Search ..... 440/38–40, 440/47–49; 114/55.5
See application file for complete search history.

(56) References Cited

U.S. PATENT DOCUMENTS 3,839,859 A 10/1974 Woell, Jr.
3,874,316 A 4/1975 Lorenz
4,795,273 A 1/1989 Henriksson et al.
5,683,278 A 11/1997 Pietsch et al.
5,713,769 A * 2/1998 Jones ..... 440/38
6,000,701 A 12/1999 Burgess
6,168,485 B1 * 1/2001 Hall et al. ..... 440/89 R
6,250,977 B1 6/2001 Ness
6,273,768 B1 8/2001 Blanchard
6,287,162 B1 9/2001 Freitag et al.
6,666,736 B2 12/2003 Fuse et al.
6,796,858 B2 9/2004 Dusablon et al.
6,857,920 B2 2/2005 Marathe et al.
6,872,110 B2 3/2005 Fuse
7,001,228 B2 2/2006 Fuse et al.

* cited by examiner

*Primary Examiner*—Lars A. Olson
*Assistant Examiner*—Daniel V Venne
(74) *Attorney, Agent, or Firm*—Ingrassia, Fisher & Lorenz, P.C.

(57) ABSTRACT

A seal pressure vent system for a waterjet propulsion apparatus including a water intake section and a pumping unit. The pumping unit is designed such that in operation the seal pressure vent system provides a fluidic path for the flow of high pressure water away from a lip seal assembly toward a near ambient pressure region. The seal vent system includes a plurality of fluid passageways formed in a stator structure in conjunction with a water barrier ring, a tail cone including an extended flange, or a modified stator web structure.

18 Claims, 4 Drawing Sheets

SEAL PRESSURE VENT SYSTEM FOR A WATERJET APPARATUS

FIELD OF THE INVENTION

The present invention relates generally to a waterjet propulsion apparatus. More particularly, the present invention relates to an improved waterjet propulsion apparatus including a seal pressure vent system for relieving high pressure at a lip seal assembly.

BACKGROUND OF THE INVENTION

The main components of a waterjet propulsion apparatus are an intake section, a pump, and a nozzle. Water enters the unit through the intake section, which scoops water into the apparatus and directs it in the aft direction. The pump includes a rotor, also referred to as an impeller, and a stator located downstream thereof, both of which are located within a water conduit or flowpath. The rotor is turned on a shaft that is driven by the prime mover of the vehicle. The rotor adds energy to the water, which then has a higher velocity and pressure. The swirl induced by the rotor is for the most part removed by the stator, which does not rotate. At the outlet end of the conduit, downstream of the stator, is located a funnel-shaped nozzle, which reduces the cross-sectional area of the flowing stream and thereby increases the thrust. In some embodiments the stator and the nozzle are an integrated unit. The thrust produced by the pump propels a marine vehicle.

The rotor is supported on bearings which are protected by a lip seal assembly to prevent high-pressure water from leaking into a bearing cavity of the apparatus. Water leakage into this area may result in bearing corrosion and possible bearing failure. Typically the lip seal assembly is subject to high static pressure at the gap between the rotor exit and stator inlet. This high pressure may result in seepage of water into the bearing cavity due to heavy wear on the lip seal assembly elements, and consequent corrosion of the bearing assembly in the bearing cavity.

Accordingly, it is desirable to provide for an improved waterjet propulsion apparatus that includes a reduction in excessive lip seal wear and the possibility of water leakage into the bearing cavity due to high pressure upstream of the lip seal assembly. In addition, it is desirable to extend the life of the component elements of the lip seal assembly. Finally, it is desired to provide a system for preventing corrosion to the bearing assembly in a waterjet propulsion apparatus that is less costly as compared to the alternative of replacing a damaged lip seal assembly and a bearing assembly with new ones. The present invention addresses one or more of these needs.

SUMMARY OF THE INVENTION

There has now been developed a waterjet propulsion apparatus including a seal pressure vent system that satisfies one or more of the above-noted deficiencies. In one embodiment, the waterjet propulsion apparatus comprises a housing having at least a water intake section and a pumping unit disposed within the housing and in fluidic communication with the water intake section. The pumping unit is comprised of a rotor comprising a plurality of rotor blades coupled to a rotor hub and having a bearing cavity formed therein, a stator having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between, and having a seal cavity formed therein that is in fluid communication with the gap. The pumping unit is further comprised of a bearing assembly housed within the bearing cavity and a lip seal assembly positioned between the seal cavity and the bearing cavity to at least inhibit water from entering the bearing cavity. A seal pressure vent system defines a flow path that extends through at least a portion of the stator hub and includes at least an inlet and an outlet, the flow path inlet in fluid communication with the seal cavity, the flow path outlet in fluid communication with the stator fluid outlet.

In a further embodiment, still by way of example only, there is provided a pumping unit for a waterjet propulsion apparatus, the pumping unit is comprised of a rotor comprising a plurality of rotor blades coupled to a rotor hub and having a bearing cavity formed therein, a stator comprising having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between, and having a seal cavity formed therein that is in fluid communication with the gap. The pumping unit is further comprised of a bearing assembly housed within the bearing cavity, a lip seal assembly positioned between the seal cavity and the bearing cavity to at least inhibit water from entering the bearing cavity and a seal pressure vent system, defining a flow path that extends through at least a portion of the stator hub and includes at least an inlet and an outlet, the flow path in fluid communication with the seal cavity, the flow path outlet in fluid communication with the stator fluid outlet.

In still a further embodiment, and still by way of example only, there is provided a pumping unit for a waterjet propulsion apparatus, the pumping unit is comprised of a rotor comprising a plurality of rotor blades coupled to a rotor hub and having a bearing cavity formed therein, a stator having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between and having a seal cavity formed therein that is in fluid communication with the gap, and a seal cavity formed between the rotor hub and the stator hub and defined by a stator web structure. The pumping unit is further comprised of a bearing assembly housed within the bearing cavity, a lip seal assembly positioned between the seal cavity and the bearing cavity to at least inhibit water from entering the bearing cavity, an internal stator cavity formed in the stator hub, a secondary internal stator cavity defined within the internal stator cavity, and a seal pressure vent system defining a flow path that extends through at least a portion of the stator hub and includes at least an inlet and an outlet, the flow path inlet in fluid communication with the seal cavity, the flow path outlet in fluid communication with the stator fluid outlet.

Other independent features and advantages of the improved lip seal assembly will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
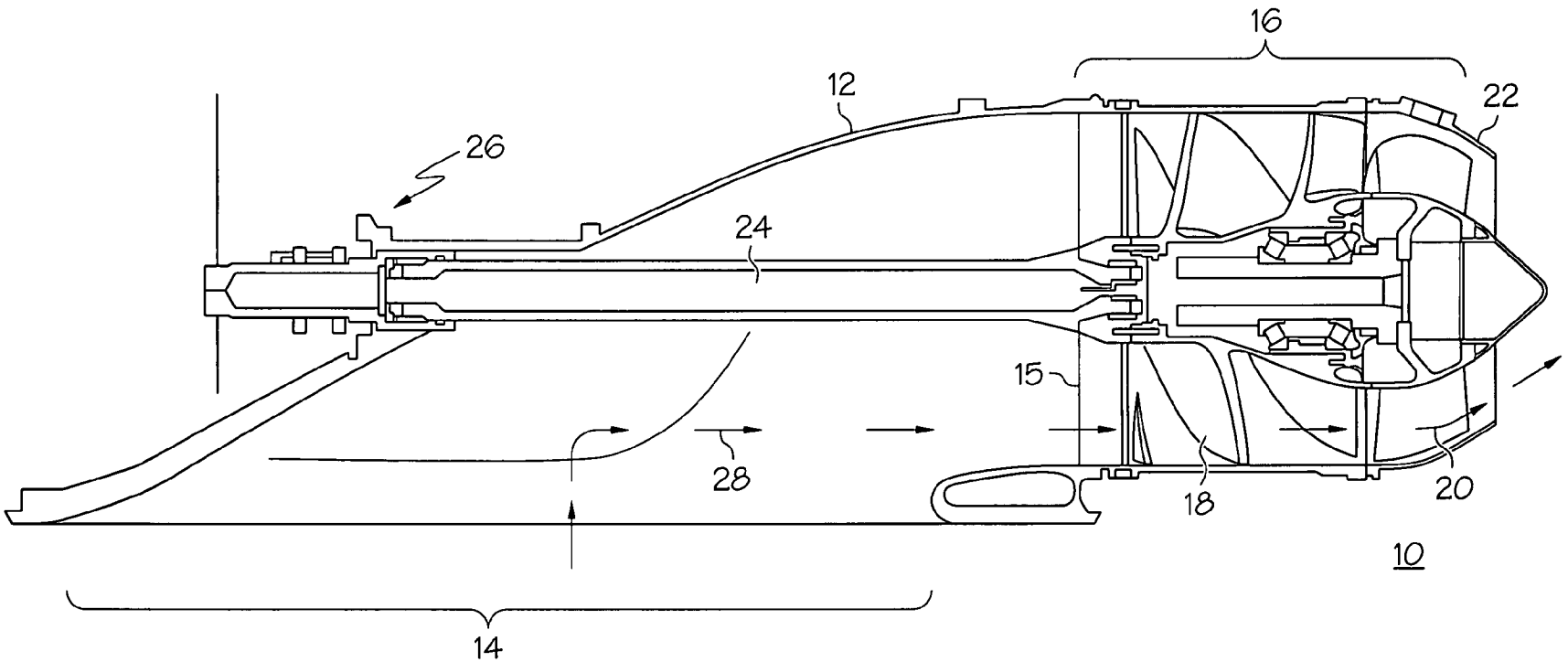
FIG. 1 is a side, cross-sectional view of a waterjet propulsion apparatus, consistent with an embodiment of the present invention.

Referring to the drawings, FIG. 1 is a simplified cross-sectional view of the main components of a waterjet propulsion apparatus 10. Waterjet propulsion apparatus 10 generally includes a housing 12, having formed or contained therein a water intake section 14, and a pumping unit 16, which includes an impeller or rotor 18 (referred to hereafter as rotor 18) and a stator 20. The apparatus 10 further includes a stator housing or nozzle 22 where during operation a high pressure flow of water is discharged as a high velocity jet stream. A driveshaft 24 attaches at a coupling 26 to turn the rotor 18.

As indicated by directional arrows in FIG. 1, during operation housing 12, rotor 18 and stator 20 contribute to the definition of the flowpath of water 28 passing there through apparatus 10. More specifically, water enters through water intake section 14 and flows upward and rearward (or downstream) toward pumping section 16. Water then passes through an inlet 15, and continues downstream to the rotor 18. Substantially all of the water then reaches the stator 26 and exits through the tapered, integrated, nozzle 22 as a high velocity jet stream. A portion of the water flow may not flow toward the stator as described below. The discharge of the high velocity jet stream generates a reaction force in the opposite direction of the flow path of water 28, which is transferred through the body of the waterjet apparatus 10 creating thrust and propelling the associated water vehicle forward.

Figure 2:
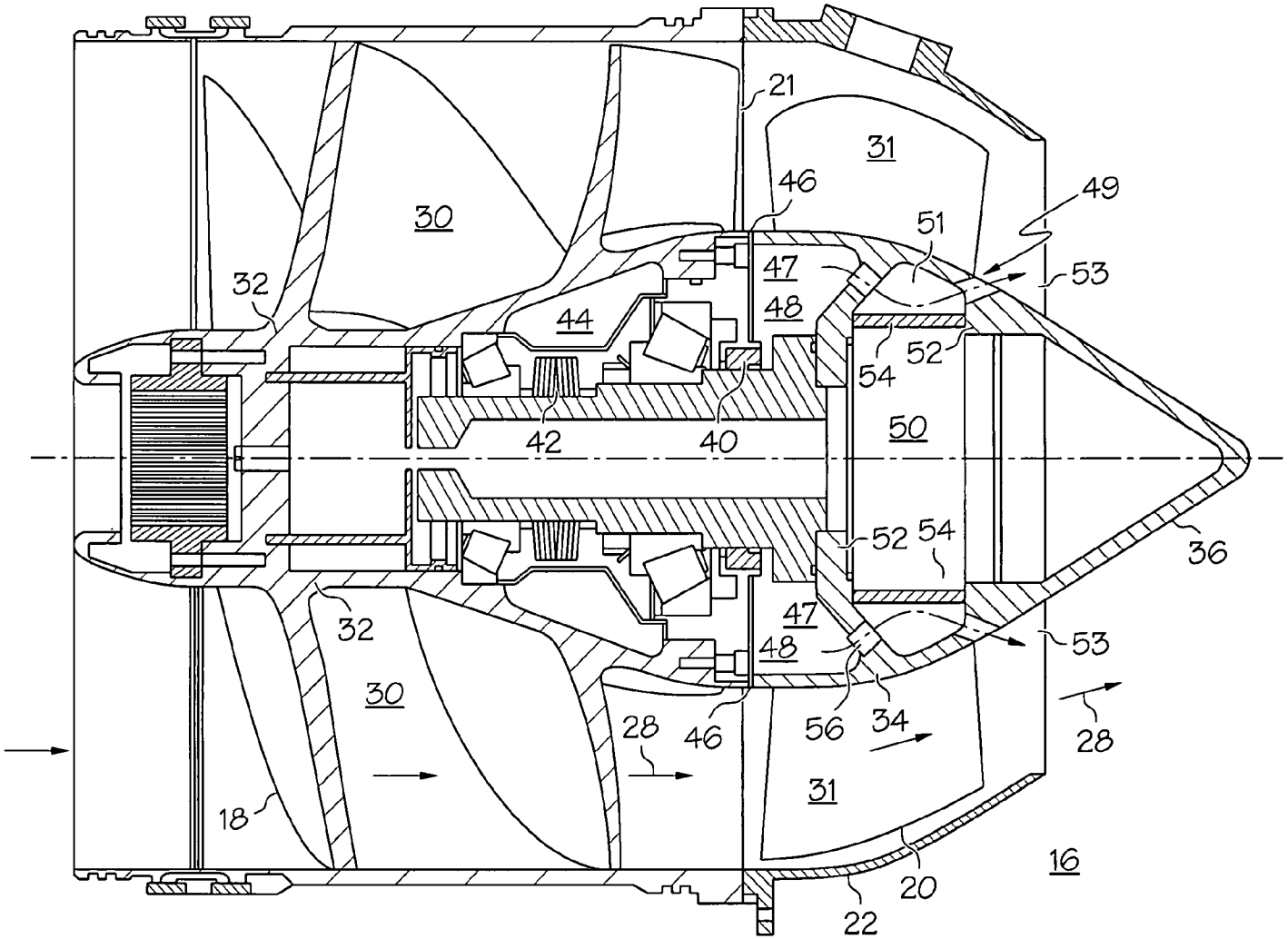
FIG. 2 is an enlarged side, cross-sectional view of a waterjet propulsion apparatus, consistent with an embodiment of the present invention.
Figure 3:
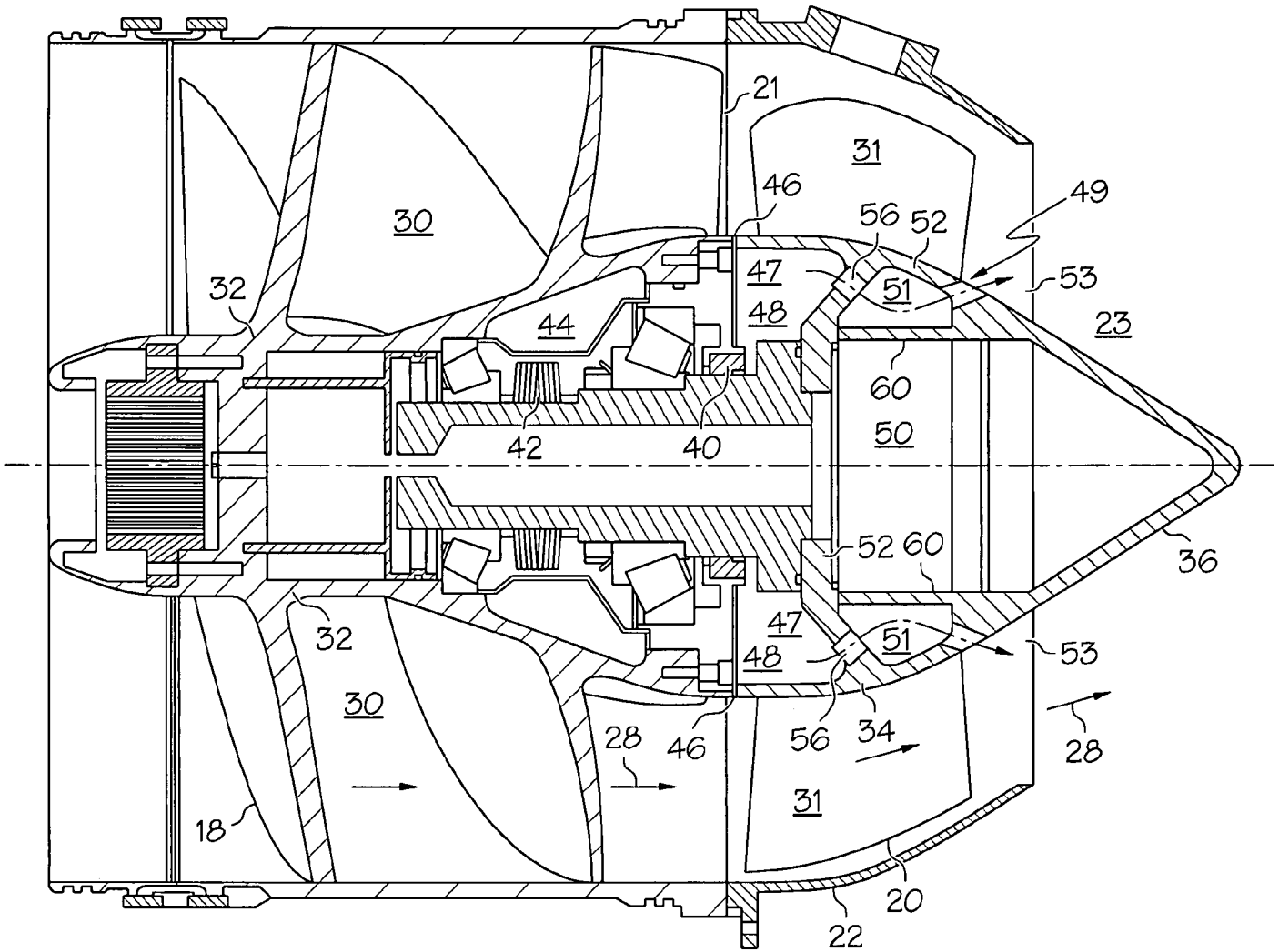
FIG. 3 is an enlarged side, cross-sectional view of a waterjet propulsion apparatus, consistent with another embodiment of the present invention.
Figure 4:
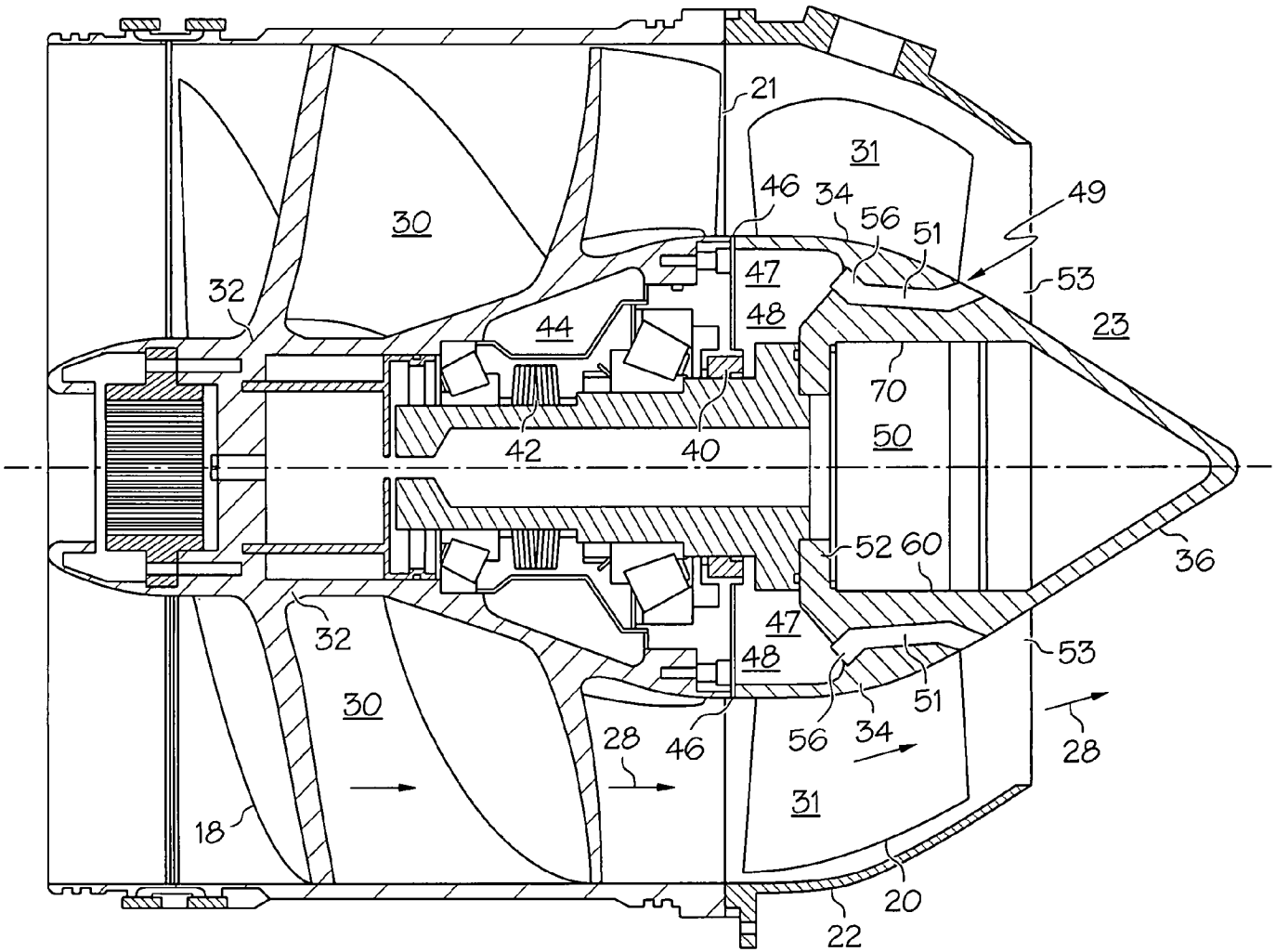
FIG. 4 is an enlarged side, cross-sectional view of a waterjet propulsion apparatus, consistent with yet another embodiment of the present invention.

Referring now to FIGS. 2-4, the features of the pumping unit 16, and in particular the seal pressure vent system according to the present invention, are addressed in greater detail. Referring more specifically to FIG. 2, illustrated in simplified enlarged cross-sectional view is a first embodiment of the pumping unit 16, including the rotor 18 that in this particular embodiment comprises five blades 30 mounted onto a rotor hub 32. The rotor 18 is driven by the drive shaft 28 (FIG. 1) that is coupled at its upstream end to a water vehicle engine (not shown). The stator 20 in this particular embodiment comprises eight blades or stator vanes 31 mounted onto a stator hub 34. The stator 20 has a fluid inlet 21 disposed adjacent the rotor 18 and a fluid outlet 23 disposed downstream of the fluid inlet 21. The stator hub 34 preferably has a tapered configuration, and tapers from an area of greater diameter at the upstream end, which is preferably about the same diameter as the downstream section of the rotor hub 32, to an area of substantially less diameter at its downstream end. For purposes of explanation, the terms downstream and upstream are interpreted in light of the directional flow path of water, indicated by reference number 28, through apparatus 10.

The stator 20 is located within stator housing/nozzle 22. It can be seen that the stator housing or nozzle 22 tapers, from an internal diameter that is substantially the same as the internal diameter of housing 12 (FIG. 1), to an internal diameter that is smaller. As illustrated in FIG. 2, the downstream end of stator hub 34 extends beyond the downstream end of stator housing/nozzle 22. The portion of the stator hub 34 extending out of the stator housing/nozzle 22 and thus the flowpath is also referred to as the tailcone 36.

Waterjet apparatus 10, and more particularly pumping unit 16 further includes a lip seal assembly 40 positioned downstream from a bearing assembly 42 housed within a bearing cavity 44. Lip seal assembly 40 is designed to prevent high pressure water that diverts from flow path 28, through a gap 46 formed between the rotor hub 32 and the stator hub 34 from entering the bearing cavity 44. The gap 46 forms an opening that is smaller relative to a plurality of isolated fluid passages or throughholes (discussed presently) in the seal pressure vent system to ensure a pressure drop and thus reduce the pressure at the lip seal assembly 40. In addition, in an alternate embodiment gap 46 may be formed by an overlapping joint that would allow for the flow of water therethrough along a more torturous path. This type of overlapping joint would provide a maximum pressure drop. Pumping unit 16 further has defined a seal cavity 48 and an internal stator cavity 50 defined by a stator structure/webbing 52.

During operation, high pressure water defined as water typically of 60 psi or greater may enter, through gap 46, the seal cavity 48. To eliminate wear and tear on lip seal assembly 40, a seal pressure vent system is incorporated into pumping unit 16. The seal pressure vent system will allow for the reduction in the pressure downstream the lip seal assembly 40 by venting the seal cavity 48 to a near ambient pressure region 53 located downstream of the exit of the stator vanes 31. The seal pressure vent system defines a flow path that extends through at least a portion of the stator hub 34 and includes at least an inlet 47 and an outlet 49. The flow path inlet 47 is in fluid communication with the seal cavity 48 and the flow path outlet 49 is in fluid communication with the stator fluid outlet 23.

In this particular embodiment, to achieve venting the seal pressure vent system includes a water barrier ring 54 that is welded to the stator structure/webbing 52 and is generally formed of a sheet metal material. The water barrier ring 54 defines within the internal stator cavity 50, a secondary internal stator cavity 51 and ensures that the water flowing there through will not collect in the internal stator cavity 50. In addition, a plurality of isolated fluid passages or throughholes 56 are defined in the stator structure/webbing 52 to provide for the flow of high pressure water entering through the gap 46 (as indicated by dashed line) to near ambient pressure region 53. The isolated fluid passages 56 may be formed as illustrated in FIG. 2, or anywhere along stator structure webbing 52 that would allow for the flow of water through secondary internal stator cavity 51 as detailed herein. In addition, isolated fluid passages 56 may be formed at the lowest point of the secondary internal stator cavity 51 to allow for complete drainage of the secondary internal stator cavity 51.

This flow of water reduces the build up of high pressure within seal cavity 48 yet has a flow rate that is small compared to the full flow rate of apparatus 10 and as such the performance impact is negligible.

Referring now to FIG. 3, an alternative embodiment of a water jet apparatus including a seal pressure vent system is illustrated. It should be noted that all components of FIG. 3 that are similar to the components illustrated in FIG. 2, are designated with similar numbers. In this particular embodiment, tail cone 36 is formed such that a portion of the tail cone 36 defines the secondary internal stator cavity 51. More specifically, tail cone 36 is formed having an extended flange ring 60 that is welded to stator structure/webbing 52 and defines the secondary internal stator cavity 51. Similar to the previous embodiment, a plurality of isolated fluid passages or throughholes 56 are defined in the stator structure/webbing 52. The isolated fluid passages 56 may be formed as illustrated in FIG. 3, or anywhere along stator structure/webbing 52 that would allow for the flow of water as detailed herein and the emptying of the secondary internal stator cavity 51.

In generally the same manner as the embodiment of FIG. 2, during operation high pressure water may enter through gap 46 and flows towards the near ambient pressure region 53, passing through the seal cavity 48, the isolated fluid passages 56 and the secondary internal stator cavity 51. The tail cone 36, and more particularly the extended flange ring 60 of tail cone 36, ensures that the flow path of the water passing there through will not collect in the internal stator cavity 50 resulting in an increase in weight to the waterjet apparatus 10.

Referring now to FIG. 4, another alternative embodiment of a water jet apparatus including a seal pressure vent system is illustrated. It should be noted that all components of FIG. 4 that are similar to the components illustrated in FIGS. 2 and 3, are designated with similar numbers. In this particular embodiment, stator hub 34, and more particularly the stator web structure 52 may be a cast or pre-fabricated stator structure 70 that includes a plurality of isolated fluid passages or through holes 56 there through connecting seal cavity 48 with the near ambient pressure region 53 at the exit of the stator 20. The stator structure 70 ensures that the water flowing there through isolated fluid passages 56 will not collect in the internal stator cavity 50. In generally the same manner as the embodiments of FIGS. 2 and 3, during operation high pressure water may enter through the gap 46 and flows towards the near ambient pressure region 53, passing through the seal cavity 48, via the isolated fluid passages 56 and to the near ambient pressure region 53. The stator structure 70 having the plurality of isolated fluid passages 56 formed there through during fabrication ensures that the water flowing there through will not collect in the internal stator cavity 50. Similar to the previous embodiments, the isolated fluid passages 56 may be formed as illustrated in FIG. 4, or anywhere along the stator structure 70 that would allow for the flow of water as detailed herein.

The components of the waterjet apparatus 10 may be fabricated of materials suitable for use in a marine environment. Preferably stainless steel is used for high usage life. A 15-5 stainless steel of PH 1150 may be used for rotors, stators, and the housing.

The problem of high pressure water buildup resulting in lip seal assembly wear and leakage can thus be solved by a seal pressure vent system as disclosed herein. The seal pressure vent system can be formed during initial stator fabrication as a stator structure modification or as a retrofit application through the addition of a plurality of fluid passageways in combination with a metal ring or modified tail cone structure. The seal pressure vent system provides a flow path for water from a high pressure region to a near ambient pressure region, thereby decreasing the pressure of the water at the lip seal assembly.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A waterjet propulsion apparatus comprising:

a housing having at least a water intake section; and a pumping unit disposed within the housing and in fluidic communication with the water intake section, the pumping unit comprising:

a rotor comprising a plurality of rotor blades coupled to a rotor hub and having a bearing cavity formed therein;

a stator having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between, and having a seal cavity formed therein that is in fluid communication with the gap;

a bearing assembly housed within the bearing cavity;

a lip seal assembly positioned between the seal cavity and the bearing cavity to at least inhibit water from entering the bearing cavity; and a seal pressure vent system defining a flow path that extends through at least a portion of the stator hub and includes at least an inlet and an outlet, the flow path inlet in fluid communication with the seal cavity, the flow path outlet in fluid communication with the stator fluid outlet.

2. The apparatus of claim 1 wherein the stator further includes:

an internal stator cavity formed in the stator hub;

a secondary internal stator cavity defined within the internal stator cavity; and a stator web structure disposed between the internal stator cavity and the seal cavity, the stator web structure having a plurality of fluid passages formed therein that fluidly couple the seal cavity to the secondary internal stator cavity and at least partially define the seal pressure vent system flow path.

3. The apparatus of claim 2 further comprising:

a water barrier ring fixedly attached to an interior of the internal stator cavity to define the secondary internal stator cavity.

4. The apparatus of claim 3 wherein the water barrier ring is formed of a sheet metal.

5. The apparatus of claim 2 further comprising:

a prefabricated tail cone structure including a flange ring that defines the secondary internal stator cavity.

6. The apparatus of claim 1 further comprising:

a prefabricated stator web structure having formed therein a plurality of fluid passageways to define the flow path.

7. A pumping unit for a waterjet propulsion apparatus, the pumping unit comprising:

a rotor comprising a plurality of rotor blades coupled to a rotor hub and having a bearing cavity formed therein;

a stator having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between, and having a seal cavity formed therein that is in fluid communication with the gap;

a bearing assembly housed within the bearing cavity;

a lip seal assembly positioned between the seal cavity and the bearing cavity to at least inhibit water from entering the bearing cavity; and a seal pressure vent system, defining a flow path that extends through at least a portion of the stator hub and includes at least an inlet and an outlet, the flow path in fluid communication with the seal cavity, the flow path outlet in fluid communication with the stator fluid outlet.

8. The pumping unit of claim 7 wherein the pumping unit further includes an internal stator cavity formed in the stator hub.

9. The pumping unit of claim 8 wherein the seal pressure vent system further comprises:

a secondary internal stator cavity defined within the internal stator cavity; and a stator web structure disposed between the internal stator cavity and the seal cavity, the stator web structure having a plurality of fluid passages formed therein that fluidly couple the seal cavity to the secondary internal stator cavity and at least partially define the seal pressure vent system flow path.

10. The pumping unit of claim 9 further comprising:

a water barrier ring fixedly attached to an interior of the internal stator cavity to define the secondary internal stator cavity.

11. The pumping unit of claim 10 wherein the water barrier ring is formed of a sheet metal.

12. The pumping unit of claim 9 further comprising:

a prefabricated tail cone structure including a flange ring that defines the secondary internal stator cavity.

13. The apparatus of claim 8 further comprising:

a prefabricated stator web structure having formed therein a plurality of fluid passageways to define the flow path.

14. A pumping unit for a waterjet propulsion apparatus, the pumping unit comprising:

a rotor comprising a plurality of rotor blades coupled to a rotor hub and having a bearing cavity formed therein;

a stator having a fluid inlet disposed adjacent the rotor, and a fluid outlet disposed downstream of the fluid inlet, the stator comprising a plurality of stator blades coupled to a stator hub, the stator hub spaced apart from the rotor hub to define a gap there between and having a seal cavity formed therein that is in fluid communication with the gap;

a seal cavity formed between the rotor hub and the stator hub and defined by a stator web structure;

a bearing assembly housed within the bearing cavity;

a lip seal assembly positioned between the seal cavity and the bearing cavity to at least inhibit water from entering the bearing cavity;

an internal stator cavity formed in the stator hub;

a secondary internal stator cavity defined within the internal stator cavity; and a seal pressure vent system defining a flow path that extends through at least a portion of the stator hub and includes at least an inlet and an outlet, the flow path inlet in fluid communication with the seal cavity, the flow path outlet in fluid communication with the stator fluid outlet.

15. The pumping unit of claim 14 further comprising:

a water barrier ring fixedly attached to an interior of the internal stator cavity to define the secondary internal stator cavity.

16. The pumping unit of claim 15 wherein the water barrier ring is formed of a sheet metal.

17. The pumping unit of claim 14 further comprising:

a prefabricated tail cone structure including a flange ring that defines the secondary internal stator cavity.

18. The pumping unit of claim 14 further comprising:

a prefabricated stator web structure having formed therein a plurality of fluid passageways to define the flow path.

* * * * *